United States Patent [19]

Caferro

[11] Patent Number: 4,951,443

[45] Date of Patent: Aug. 28, 1990

[54] CEILING PANEL AND T-RAIL MOUNTING ASSEMBLY

[75] Inventor: Ronald N. Caferro, Spokane, Wash.

[73] Assignee: Ecolite Manufacturing Co., Spokane, Wash.

[21] Appl. No.: 362,796

[22] Filed: Jun. 6, 1989

[51] Int. Cl.[5] ..... E04B 1/60

[52] U.S. Cl. ..... 52/764; 52/484; 52/507

[58] Field of Search ..... 52/507, 484, 764, 775, 52/663; 362/147, 148, 150, 354

[56] References Cited

U.S. PATENT DOCUMENTS

| | | | |
|---|---|---|---|
| 1,997,595 | 4/1935 | Nold et al. | 52/484 |
| 2,698,071 | 12/1954 | Lee | 52/484 |
| 3,023,866 | 3/1962 | Moore | 52/484 |
| 3,795,076 | 3/1974 | Anderson | 52/775 |
| 4,175,281 | 11/1979 | Lonseth | 362/148 |
| 4,424,554 | 1/1984 | Woloski et al. | 362/150 |

*Primary Examiner*—James L. Ridgill, Jr.

*Attorney, Agent, or Firm*—Wells, St. John & Roberts

[57] ABSTRACT

A panel and clip construction are disclosed for suspending or for mounting the panel to a conventional T-rail support grid. The panel includes a panel body of a prescribed peripheral configuration. Centering brackets are mountable to the panel grid members about the panel periphery. The centering brackets each include end surfaces for engaging facing edge surfaces of the T-rail. The end surfaces of the centering brackets are positioned on the panel to engage edges of the T-rail and precisely center the panel within a grid opening formed by the T-rails. Clips are selectively provided in the assembly and are spring biased by bracket bases to selectively engage and support the panel from the t-rails. The bracket bases, clips, and centering brackets are selectively assemblable on the panel through openings along top edges thereof. Selectively positioned notches along the top edges serve to locate the end surfaces of the centering brackets and thereby facilitate the centering capabilities of the surfaces.

18 Claims, 5 Drawing Sheets

CEILING PANEL AND T-RAIL MOUNTING ASSEMBLY

TECHNICAL FIELD

The present invention relates to removable panel construction for ceilings and the like, and more particularly to panels and clip arrangements for mounting panels to a gridwork of "T-rail" supports.

BACKGROUND OF THE INVENTION

Ceiling lighting grids are known for use alone or in conjunction with acoustic panels in suspended ceilings. Such panels are typically suspended from a gridwork of frame members commonly referred to as "T-rails". The T-rails are suspended usually by wire ties from the original ceiling or ceiling framework. The T-rails intersect to define prescribed openings for receiving and supporting successive panels.

It is often desirable to span an entire ceiling area with panels, suspended one next to another in such a manner that the T-rails are hidden and no joint or seam is visible between successive panels. While this objective is desirable, many panel mounting arrangements leave undesired and unsightly gaps between adjacent panels.

Gaps between successive panels may be eliminated or controlled to maintain a visually acceptable uniformity by precisely centering each panel within its opening between the suspended T-rails. It thus becomes desirable to obtain some form of panel construction and mounting device thereon for enabling precise centering of the panel within the supporting T-rail framework.

BRIEF DESCRIPTION OF THE DRAWINGS

A preferred embodiment of the invention is illustrated in the accompanying drawings, in which:

FIG. 1 is a fragmented exploded view of a ceiling panel arrangement with a single panel including features of the present invention separated therefrom;

FIG. 10 is an enlarged fragmentary view illustrating the relationship between the centering bracket, clip, and base in relation to portions of a panel.

DETAILED DESCRIPTION OF THE PREFERRED EMBODIMENT

Figure 11:
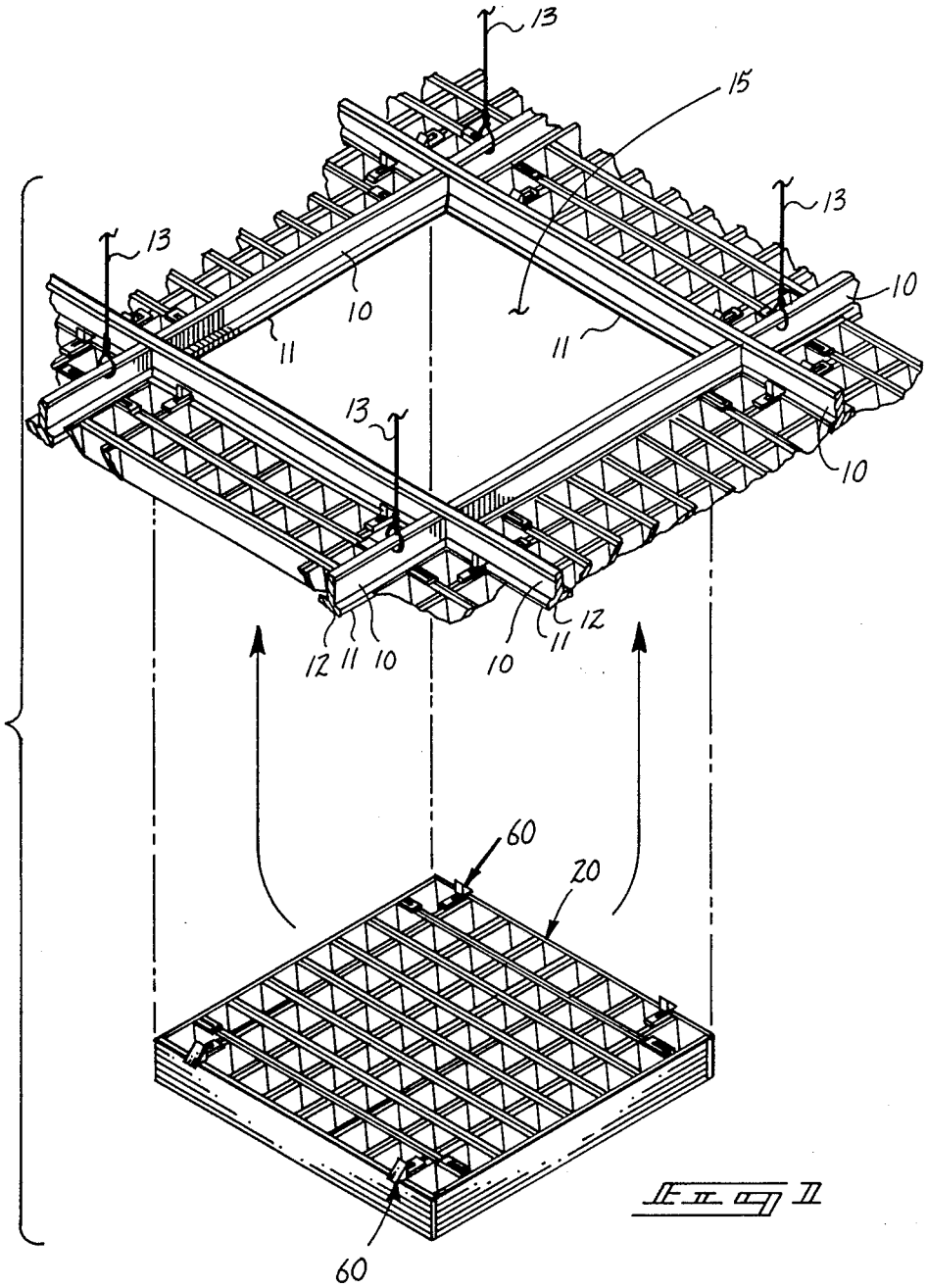
FIG. 11 is a partially sectioned view illustrating connection and disconnection of a panel from a T-rail support.

The following disclosure of the invention is submitted in compliance with the constitutional purpose of the Patent Laws "to promote the progress of science and useful arts" (Article 1, Section 8).

The present invention is intended for use with a support system made up of a grid or network of intersecting "T-rails" 10. T-rails 10 are commonly utilized for supporting suspended ceilings, lighting panels, and the like. A typical T-rail 10 includes opposed support edges 11 formed along horizontal flanges 12. The T-rails are typically supported by suspension wires 13 which extend between upright central leg sections 14 of the T-rails to an adjacent support surface such as a ceiling or other support structure (not shown).

The T-rails typically are formed in a gridwork, intersecting one another to form uniform openings 15. The opening peripheries are defined by the T-rail support edges 11. It is typical that the openings are uniform in size and configuration. It is also typical that the openings are rectangular as shown in the drawings. However, it is conceivable that other opening configurations may be utilized by panels incorporating features of the present invention. The only requirement is that the panels include a configuration similar to the openings 15 to facilitate mounting of the panel members along the T-rails 10.

Figure 2:
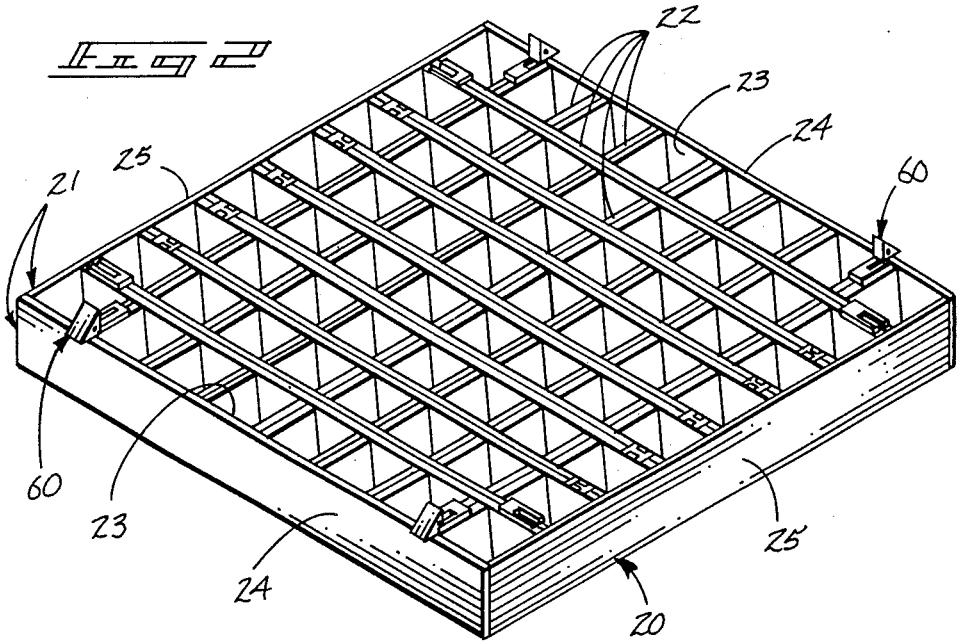
FIG. 2 is an enlarged perspective view of the panel incorporating features of the present invention.

A ceiling panel 20 incorporating important features of the present invention is shown in the drawings generally in FIG. 1 and more specifically in FIG. 2. The ceiling panel 20 includes a body 21 formed of intersecting grid members 22. The grid members 22 terminate at a panel perimeter 23. For purposes of this description, the perimeter is defined as including first side edges 24 and second side edges 25. The first side edges 24 are advantageously substantially parallel and opposed across the panel body. The second perimeter edges 25 interconnect the first edges 24. Edges 25 are also preferably parallel. The edges 24 and 25 define the periphery which is intended to be substantially complementary to the configuration of the various openings 15. In the example shown, the ceiling panel includes a rectangular perimeter configuration. The panel many be formed in other configurations as desired. This is also true of the grid members which may be formed in other desired configurations.

Details of the exemplary ceiling panel are shown in FIGS. 2, 10, and 11. There it will be seen that the grid members 21 include top edges 26 and opposed bottom edges 27. The distance between these edges is the thickness dimension of the panel.

The top edges 26 include openings 28 at or adjacent to the perimeter 23. The openings 28 are cut or stamped from flanges 29 which project toward one another across the width of each grid member at the top edge 26 thereof. Care is taken that opening edges 31 are precisely located a common prescribed distance from the adjacent panel edges 24, 25. The flanges and openings are best viewed in FIG. 10.

Edge portions 31 of flanges 29 which partially form the openings 28 define a positioning means 30, along with centering brackets 34 for precisely centering the panel within an opening 15. Centering brackets 34 are mounted about the perimeter of the panel body. Each bracket 34 includes outwardly extending legs 35 defining the slot 36 therebetween. The legs 35 extend to end surfaces 37 for engaging the T-rail edges 11.

Tabs 39 are advantageously provided on each of the centering brackets 34. The tabs 39 project downwardly (FIGS. 5, 8–10) from the brackets to be engaged by the opening edges 31 of the ceiling panel. The tabs are situated at a prescribed distance from the leg end surfaces 37. Thus, the positioning means 30 serves to precisely locate the end surfaces 37 of the legs 35 in relation to the panel perimeter 23. The precisely positioned end surfaces 37 facilitate centering of the panel within an opening 15. The bracket leg end surfaces 37 abut the T-rail edges 11 and therefore precisely center the panel within the opening 15.

The centering brackets 34 are preferably mounted to bracket bases 45. A bracket base 45 is provided for each centering bracket 34 and is adapted to be received within each of the grid members 22 through an opening 28 therein. Bracket base 45 is selectively secured to a centering bracket 34 by a fastener 43. The fastener extends through the centering bracket and into a top panel gripping surface 47 of the bracket base 45. Fastener 43 serves to clamp the grid member flanges 29 between the base top panel gripping surface 47 and a bottom panel gripping surface 42 of a bracket 34. The top surface of the bracket base 45 includes notches 48 (FIG. 9) for receiving the tabs 39 of brackets 34.

Tapered side surfaces 49 extend downwardly from the top surface 47 of each bracket base 45. The tapered side surfaces are shaped to be intimately received within the complementary shaped cross-sectional configuration of the grid members 22 (dashed line, FIG. 10).

The downwardly extending portion of each base 45 includes a "U" shaped open frame 46. A spring biasing means 53 extends upwardly and in a central location within the "U" shaped frame 46. Spring biasing means 53 is preferably in the form of an upstanding resilient finger 54 having an angularly projecting contact 55 at its upward end.

The upstanding finger 54 is preferably integral with the bracket base 45. Thus, for resiliency, it is preferred that the entire bracket base be formed of a suitable plastic material. In fact, it is preferable that the entire unit be formed of the same material. It has been found that an acetal copolymer, specifically Grace M-90 "Celcon" brand acetal includes desired properties for the centering brackets and base. This material may also be used for construction of a clip 60 (FIGS. 6–10).

Clips 60 are provided on selected centering brackets 34 and are biased by the spring biasing means 53 to engage T-rail support members in order to suspend the panel therefrom.

Figure 8:
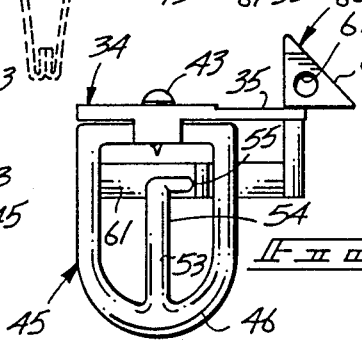
FIG. 8 is side elevation view as seen from the right in FIG. 7.
Figure 9:
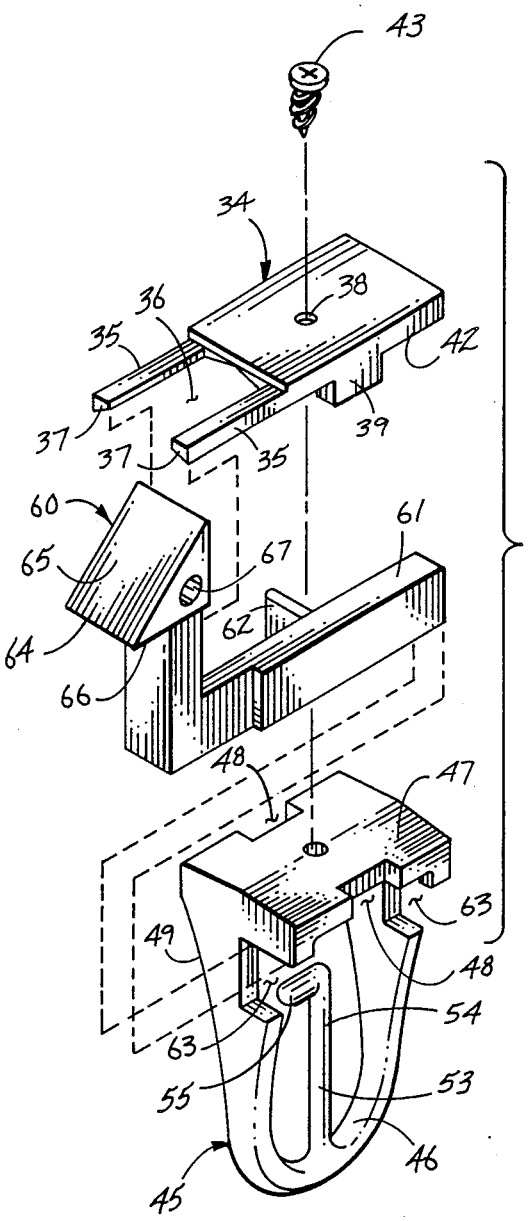
FIG. 9 is an enlarged exploded view of the assembly shown in FIG. 8.
Figure 11:
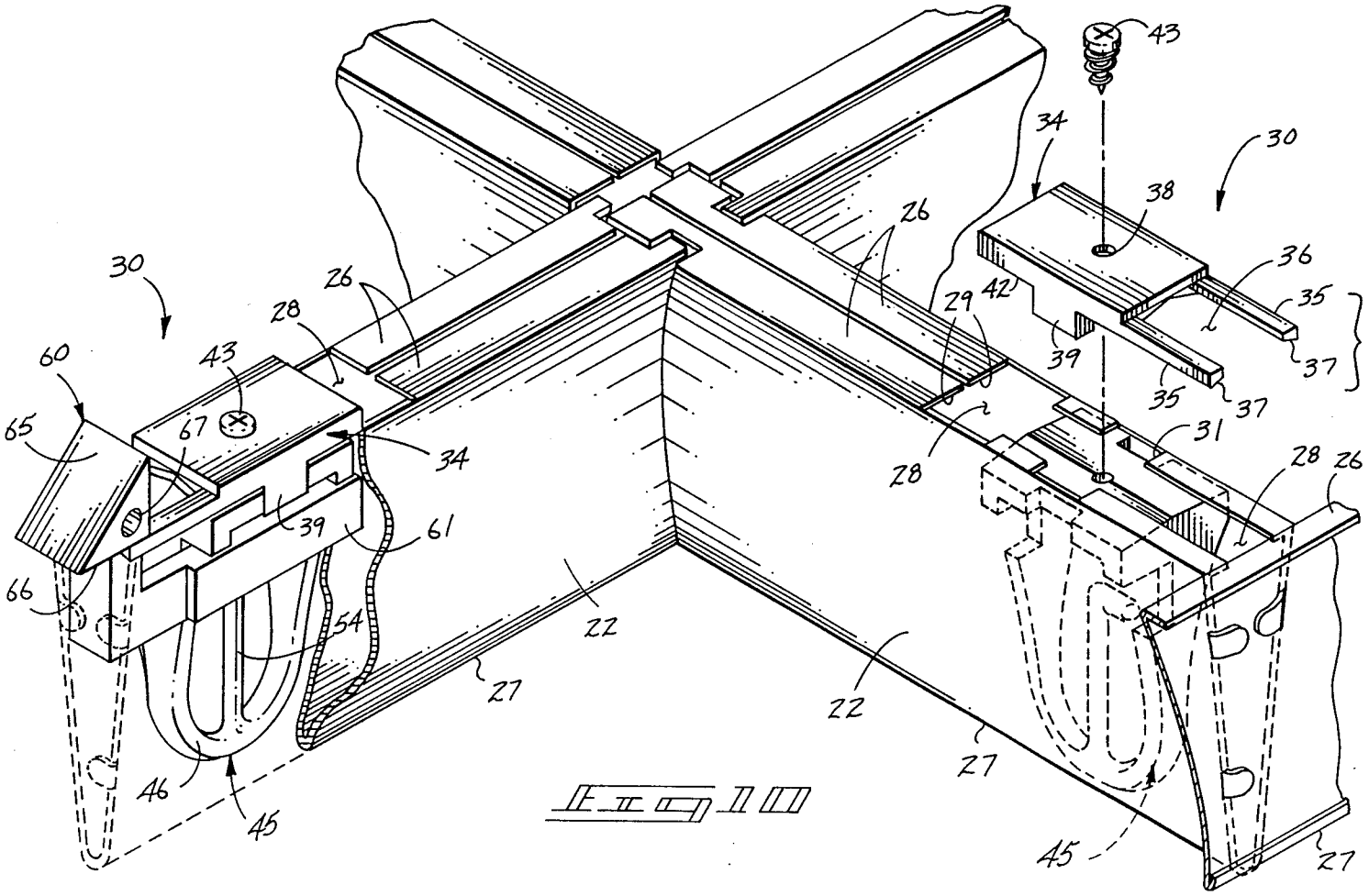
Figure 11:
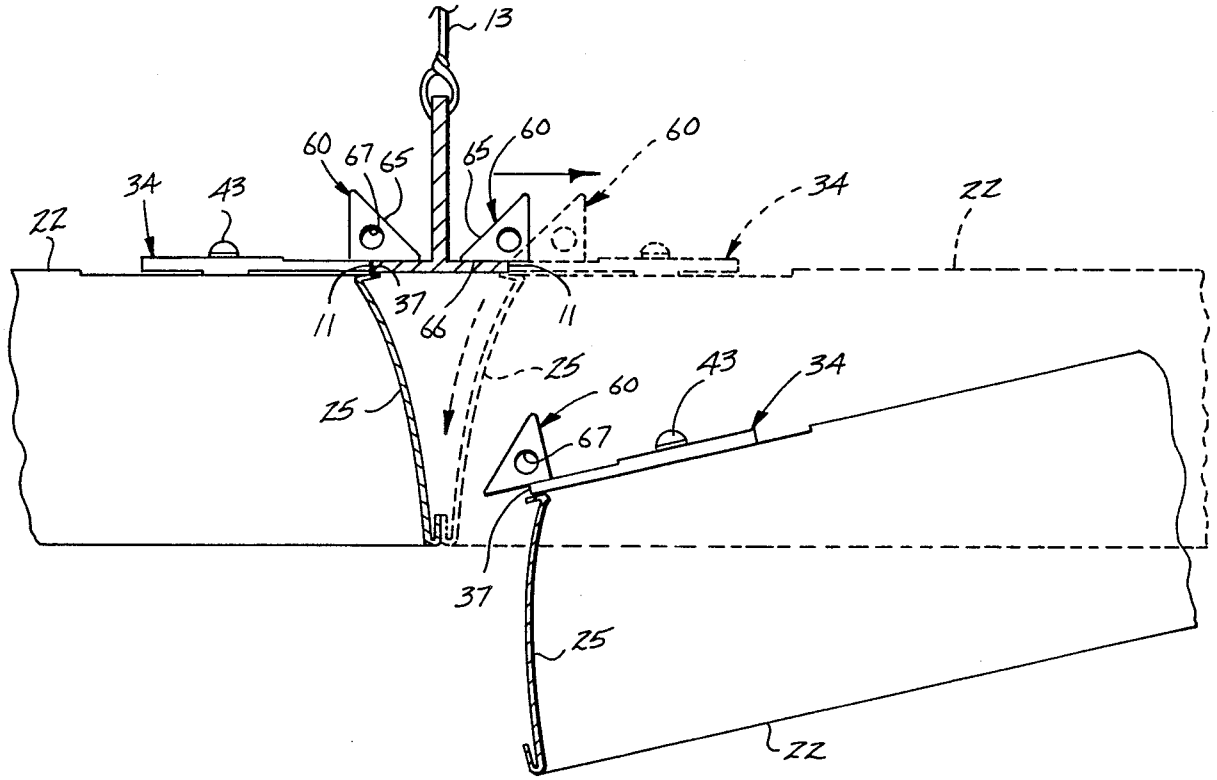

It is important to note that the clips 60 are removably mountable to the bracket bases 45. Each clip includes a slide body that is received within aligned notches 63 in an associated bracket base 45. An actuator tab 62 extends laterally from each slide body 61 to be received between the upright legs of the "U" shaped base frame 46. The tab 62 abuts the contact 55 of the spring biasing means. Notches 63 serve to guide the slide body in a translational path between solid and dashed line positions as indicated in FIG. 8.

A forward end of slide body 61 includes an upwardly extending catch member 64. The catch member 64 includes an upwardly facing angular cam surface 65. The catch 64 also includes a downwardly facing flat surface 66 that slides along the top surface of the centering bracket 34.

The upwardly extending catch member 64 is slidably received between the centering bracket legs 35 and within the slot 36. The legs 35 and notches 63 guide the slide body and catch in translational motion between the positions indicated in FIG. 8.

The actuator tab 62 slidably engages the contact 55. The contact 55 slides over the contacted surface of the actuator tab as the clip 60 moves translationally between releasing and engaging positions as indicated in FIG. 8. The spring finger and contact 55 thus does not apply significant upward or downward forces to the clip that could otherwise cause binding between the clip and the notches 63 or the inwardly facing surfaces of the centering bracket legs 35.

Each of the upwardly projecting catches 64 includes an access hole 67. The holes 67 are provided to receive a panel removal tool (not shown) should the thickness dimension of the panel (between top and bottom edges 26, 27) be such that finger access is not permitted.

Figure 3:
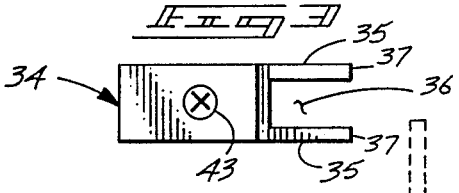
FIG. 3 is a top plan view of a centering bracket of the present invention.
Figure 4:
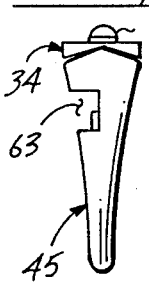
FIG. 4 is an end view of the centering bracket and a bracket base.
Figure 5:
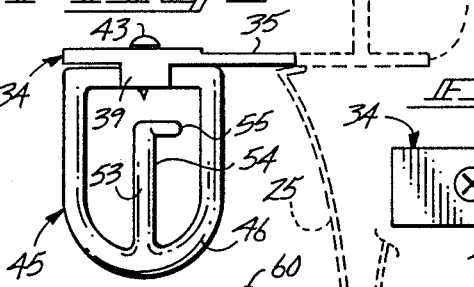
FIG. 5 is a side elevation view of the centering bracket and bracket base with a portion of T-rail and panel shown in dashed lines.
Figure 6:
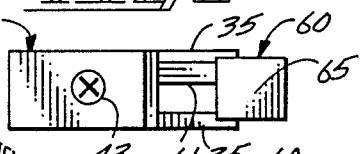
FIG. 6 is a view similar to FIG. 3 only additionally showing a clip thereon.
Figure 7:
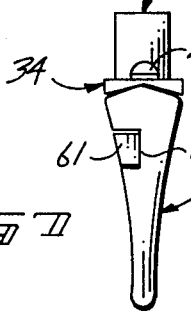
FIG. 7 is an end elevation view as seen from the left in FIG. 6.

It is once again noted that the clips 60 are removably mountable to bracket bases 45 and centering brackets 34. This arrangement facilitates selective use of the assemblies in the manner shown in FIG. 3 where clips 60 are used only along the first perimeter edges 24 and the centering brackets 34 are about the entire perimeter. Thus, the centering function of the brackets 34 is provided about the entire perimeter of the grid while the support function of the clips 60 is provided only along opposed edges 24.

Including the clips 60 at only two opposed edges of the panel facilitates ease in removal of the panel by a single installer. The installer may simply retract two of the spring clip members 60 along one panel edge 24 in order to disengage the flat surfaces 66 from the upwardly facing horizontal flange surfaces of the T-rails. This will allow the panel to swing downwardly as shown diagrammatically in FIG. 11. The two adjacent sides 25 of the panel will swing free, clear of the T-rails as there are no clips engaging the T-rail surfaces on those sides.

The centering brackets and clips may be mounted to a panel making use of the panel openings 28, during construction of the panel, or at the job site. Mounting the above components to the panel begins simply by inserting the bracket base 45 downwardly through a desired opening 28. This may be done with or without a clip 60 attached to the base 45. When the clip is included, the base 45 and slide body 61 are inserted downwardly through the opening in such a manner that the top surface of the bracket base 47 is situated just below the adjacent panel flanges 29 and so the clip catch 64 remains exposed above the flanges. The bracket base and clip slide body 61 are received within the grid member with side surfaces thereof in free sliding engagement with inwardly facing surfaces of the adjacent grid sections. The grid therefore holds the slide body 61 in position within the notches 63 but enables relatively free translational sliding movement thereof.

The centering bracket 34 is mounted next. This is done simply by placing the centering bracket on the top surface of the grid member flanges 29 and tabs 39 extending downwardly through the portions of the opening defined by the formed edges 31 of the inward projecting flanges 29. The flange edges 31 and tabs 39 thus automatically position the end surfaces 37 of the centering bracket legs 35.

Notches 48 of the bracket base are aligned with the flanges 29 to receive the centering bracket tabs 39. This is done by sliding the bracket longitudinally within the grid member until such alignment occurs.

Next, a fastener 43 such as a screw is secured through the centering bracket and into the bracket base to clamp the flange gripping surfaces against the grid member flanges 29. This secures the centering bracket on the panel and holds the bracket base securely within the grid member. Longitudinal motion of these members is also restricted by the outward flange edges of opening 28, which abut the centering bracket tabs 39. The leg end surfaces are thus held securely and accurately in relation to the panel perimeter edges 24, 25.

Assembly may occur using the same procedures but without including the clips 60. The result may be an assembly as shown substantially in FIG. 5 and in FIG. 10 along the right hand portion of that view. This arrangement of centering bracket and bracket base facilitates the centering feature without the clipping action provided by a clip 60. Advantages of this arrangement are discussed above.

A fully assembled panel is ready for installation. The installer simply pushes the panel upwardly, snapping the clips 60 against yieldable resistance of the spring fingers over the T-rail support edges 11 as indicated above. While lifting the panel the installer positions the end surfaces 37 of the centering brackets in contact with the T-rail edges 11. This automatically centers the panel within the opening 15. The precisely centered position is repeatable due to the substantially permanent positioning of the centering bracket end surfaces 37. This repeatable, precision centering feature facilitates mounting of successive panels within successive openings with extreme precision.

Removal of the panel is accomplished simply by retracting two of the clips 60 along one of the side edges 24. This allows the panel to swing downwardly as briefly described above and enables the remaining clips to slide from contact with the adjacent T-rail. Deeper or thicker panel configurations may require use of a tool (not shown) which may be utilized to engage the tool receiving access hole 67 of the clip catches 64 to facilitate removal of the panel.

The selective positioning of the catches and universal nature of the centering brackets facilitates precision mounting of the panels as indicated above. Selective positioning of the clips has further advantages during installation. If for example it is not feasible (due to an adjacent obstruction) to remove a panel by releasing one edge and swinging it downwardly, the spring clips from that edge can be moved to another side to an alternate release position. This can be accomplished simply by replacing or removing the clips from one set of bracket bases and attaching them to another. This function can easily be accomplished at the jobsite without requiring more than a standard tool for removing the fastener 43.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A ceiling panel for mounting to a T-rail ceiling support structure having a gridwork of intersecting T-rail support members defining an opening for receiving the ceiling panels and including T-rail support edges facing one another across and defining said opening, the panel comprising:

a panel body having a perimetral shape complementary to the opening defined by the T-rail support members;

a plurality of centering brackets mounted to the panel body about the perimeter of the panel body and having end surfaces thereon;

wherein the end surfaces are spaced apart across the panel body by distances substantially equal to corresponding distances between facing T-rail support edges, to thereby engage the T-rail support edges and center the panel within the opening; and clips on selected centering brackets, including a bias spring urging the clips against the T-rail support members to suspend the panel therefrom.

2. The ceiling panel of claim 1 wherein the panel includes positioning means thereon cooperative with the centering brackets for locating the centering brackets thereon with the end surfaces positioned to engage the T-rail edges and center the grid within the opening.

3. The ceiling panel of claim 1 wherein the centering brackets are releasably mounted to the panel body, and the clips are releasably mounted to the centering brackets.

4. The ceiling panel of claim 3 further comprising a bracket base for each centering bracket mountable to the panel body and including biasing means for urging the associated clip towards a T-rail engaging position.

5. The ceiling panel of claim 1, further comprising a bracket base for each centering bracket and wherein the centering brackets are releasably mountable to the bracket bases.

6. The ceiling panel of claim 5 wherein the bracket bases each includes spring biasing means engageable on associated clip for yieldably urging the clip toward a T-rail engaging position.

7. The ceiling panel of claim 6 wherein the spring biasing means are integral with the bracket bases.

8. A ceiling panel clip assembly mountable to a ceiling panel to mount the panel to a T-rail support structure including facing T-rail support edges defining a panel receiving opening, comprising:

a bracket base mountable to the ceiling panel;

a centering bracket on the bracket base having a T-rail support edge engaging end surface thereon for engaging the T-rail support edge to position the panel in centered relation to the T-rail; and a clip removably mountable to the centering bracket and bracket base, movable in relation to the end surface for engaging the T-rail and supporting the panel therefrom.

9. The ceiling panel clip assembly of claim 8 wherein the centering bracket is removably mountable to the bracket base.

10. The ceiling panel clip assembly of claim 8 further comprising a spring on the bracket base for engaging the clip and yieldably biasing the clip toward a T-rail engaging position.

11. The ceiling panel clip assembly of claim 10 wherein the spring is integral with the bracket base.

12. The ceiling panel clip assembly of claim 8 wherein the centering bracket is slotted to slidably receive the clip and to guide the clip for translational movement between T-rail engaging and disengaging positions.

13. The ceiling panel clip assembly of claim 12 wherein the centering bracket is removably mountable to the bracket base.

14. The ceiling panel clip assembly of claim 8 wherein the bracket base and centering bracket are separable and include opposed panel gripping surfaces; and a fastener for securing the bracket base and centering bracket together with a portion of the panel gripped between the panel gripping surfaces.

15. The ceiling panel clip assembly of claim 14 wherein the centering bracket is slotted to slidably receive the clip and to guide the clip for translational movement between T-rail engaging and disengaging positions.

16. The ceiling panel clip assembly of claim 15 further comprising a spring on the bracket base for engaging the clip and yieldably biasing the clip toward a T-rail engaging position.

17. The ceiling panel clip assembly of claim 16 wherein the spring is integral with the bracket base.

18. A ceiling panel, mountable to a T-rail support including support edges facing one another across and defining a panel receiving opening, comprising:

a panel body formed of a gridwork of interconnected grid members within a perimeter defined by a first opposed pair of edges interconnected by a second opposed pair of edges, the perimeter being complementary to said opening;

bracket bases mounted to the panel body adjacent the first and second edge pairs;

a T-rail support edge engaging and centering bracket on each bracket base having an end surface thereon adjacent the first and second perimeter edges for engaging the T-rail support edges and positioning the panel in a prescribed spatial relation to the T-rail;

clips mounted to the centering brackets and bracket bases adjacent the first opposed pair of edges, the clips being movable to engage the T-rail and releasably support the panel therefrom.

* * * * *